US011255538B2

(12) United States Patent
Kozlov et al.

(10) Patent No.: US 11,255,538 B2
(45) Date of Patent: Feb. 22, 2022

(54) RADIANT INFRARED GAS BURNER

(71) Applicant: GAS TECHNOLOGY INSTITUTE, Des Plaines, IL (US)

(72) Inventors: Aleksandr Kozlov, Buffalo Grove, IL (US); David Kalensky, Chicago, IL (US); Mark Khinkis, Morton Grove, IL (US); Vladimir Shmelev, Moscow (RU); Nikolai Vasilik, Moscow (RU)

(73) Assignee: GAS TECHNOLOGY INSTITUTE, Des Plaines, IL (US)

( * ) Notice: Subject to any disclaimer, the term of this patent is extended or adjusted under 35 U.S.C. 154(b) by 440 days.

(21) Appl. No.: 16/164,368

(22) Filed: Oct. 18, 2018

(65) Prior Publication Data

US 2019/0049108 A1 Feb. 14, 2019

Related U.S. Application Data

(63) Continuation-in-part of application No. 15/016,469, filed on Feb. 5, 2016, now Pat. No. 10,488,039.

(Continued)

(51) Int. Cl.
*F23D 14/14* (2006.01)
*F23D 14/02* (2006.01)

(Continued)

(52) U.S. Cl.
CPC ..... *F23D 14/145* (2013.01); *F23D 14/02* (2013.01); *F23D 14/14* (2013.01); *F23D 14/16* (2013.01);

(Continued)

(58) Field of Classification Search
CPC ..... F23D 14/84; F23D 14/14; F23D 14/08; F23D 14/16; F23D 14/145; F23D 99/00;

(Continued)

(56) References Cited

U.S. PATENT DOCUMENTS 1,830,826 A * 11/1931 Cox ..... F23D 14/16 431/328
3,044,538 A * 7/1962 Honger ..... F23C 99/00 431/329

(Continued)

FOREIGN PATENT DOCUMENTS

RU 2 506 314 C1 2/2014
RU 2012 129 061 C1 2/2014

OTHER PUBLICATIONS

V. M. Shmelev, "Surface Burning on a Foam Metal Matrix with the Ceramic Coating" published May 2014 in Combustion Science and Technology; included as "Surface_Burning_Shmelev_2014.pdf" (Year: 2014).*

(Continued)

*Primary Examiner* — Edelmira Bosques
*Assistant Examiner* — Martha M Becton
(74) *Attorney, Agent, or Firm* — Pauley Erickson & Swanson

(57) ABSTRACT

Methods and devices for gas mixture combustion on a surface of a permeable matrix are provided which produce or result in surface stabilized combustion (SSC) with increasing amounts of radiation energy emitted by the matrix surface and decreasing concentrations of pollutant components in the combustion products. The gas mixture is fed to a burner that includes a permeable matrix material having a first thermal conductivity and configured to preheat the combustible gas mixture as it travels through the matrix. The burner includes a plurality of thermal elements having a thermal conductivity higher than and disposed in thermal transfer communication with the matrix base material. The permeable matrix base material forms a combustion surface with at least a portion of the thermal elements exposed above the combustion surface. The gas mixture is combusted at or (Continued)

near exit pores and channels formed at the permeable matrix material combustion surface.

19 Claims, 10 Drawing Sheets

Related U.S. Application Data

(60) Provisional application No. 62/113,868, filed on Feb. 9, 2015.

(51) Int. Cl.
*F23D 14/16* (2006.01)
*F23D 99/00* (2010.01)

(52) U.S. Cl.
CPC ..... *F23D 99/00* (2013.01); *F23D 2203/005* (2013.01); *F23D 2203/105* (2013.01); *F23D 2203/1012* (2013.01); *F23D 2212/005* (2013.01); *F23D 2212/10* (2013.01); *F23D 2212/20* (2013.01); *F23D 2212/201* (2013.01)

(58) Field of Classification Search
CPC ..... F23D 2212/201; F23D 2212/20; F23D 2212/10; F23D 2212/005; F23D 2203/105; F23D 2203/1012; F23D 2203/005
See application file for complete search history.

(56) References Cited

U.S. PATENT DOCUMENTS 3,170,504 A * 2/1965 Lanning ..... F23D 14/14 431/328
3,188,366 A * 6/1965 Flynn ..... F23D 14/16 432/9
3,191,659 A * 6/1965 Weiss ..... F23D 14/16 431/328
3,199,573 A * 8/1965 Fiynn ..... F23D 14/16 431/329
3,216,478 A * 11/1965 Saunders ..... F23D 14/18 431/329
3,251,396 A * 5/1966 Nitsche ..... F23D 14/125 431/328
3,270,798 A * 9/1966 Ruff ..... F23D 14/18 431/329
3,330,267 A * 7/1967 Bauer ..... F24C 3/122 126/92 R
3,425,675 A * 2/1969 Twine ..... C21D 1/74 432/199
3,472,601 A * 10/1969 Ogawa ..... F23D 14/12 431/328
3,726,633 A * 4/1973 Vasilakis ..... F23D 14/14 431/329
3,738,793 A * 6/1973 Reid ..... F23D 14/16 431/328
3,751,213 A * 8/1973 Sowards ..... F23C 99/00 431/328
3,833,338 A * 9/1974 Badrock ..... F23D 14/16 431/328
3,912,443 A * 10/1975 Ravault ..... B32B 9/005 431/328
3,920,583 A * 11/1975 Pugh ..... B01J 23/84 502/314
4,377,618 A 3/1983 Ikeda et al.
4,416,619 A * 11/1983 Craig ..... F23D 14/16 431/328
4,507,355 A * 3/1985 George ..... D06M 11/71 442/141
4,547,148 A * 10/1985 Holmer ..... F23D 14/16 431/328
4,597,734 A * 7/1986 McCausland ..... B22F 3/002 126/92 AC
4,599,066 A * 7/1986 Granberg ..... F23D 14/145 431/260
4,604,054 A * 8/1986 Smith ..... B23K 1/0053 431/328
4,643,667 A * 2/1987 Fleming ..... F23D 14/16 431/328
4,657,506 A * 4/1987 Ihlenfield ..... F23D 14/145 126/92 R
4,746,287 A * 5/1988 Lannutti ..... B28B 19/0038 264/256
4,810,587 A * 3/1989 Losfeld ..... B22F 3/002 428/549
4,878,837 A * 11/1989 Otto ..... C04B 38/067 431/328
4,878,947 A * 11/1989 Helferich ..... C04B 38/08 106/602
4,883,423 A * 11/1989 Holowczenko ..... C04B 30/02 431/328
4,886,044 A * 12/1989 Best ..... A47J 37/0682 126/39 C
4,886,972 A * 12/1989 Nakai ..... C09K 9/00 250/504 R
4,889,481 A * 12/1989 Morris ..... B32B 18/00 431/328
4,919,609 A * 4/1990 Sarkisian ..... F23D 14/12 431/328
4,923,747 A * 5/1990 McCullough, Jr .... C04B 35/117 428/312.6
4,977,111 A * 12/1990 Tong ..... C04B 30/02 501/95.1
5,062,408 A * 11/1991 Smith ..... A47J 37/0682 126/41 R
5,137,583 A * 8/1992 Parent ..... F23D 14/12 136/253
5,147,201 A 9/1992 Xiong
5,165,887 A * 11/1992 Ahmady ..... F23D 14/16 126/92 AC
5,205,731 A * 4/1993 Reuther ..... F23D 14/16 431/328
5,218,952 A * 6/1993 Neufeldt ..... E01C 23/14 126/92 AC
5,249,953 A * 10/1993 Roth ..... F23D 14/16 126/92 AC
5,326,257 A 7/1994 Taylor et al.
5,356,487 A * 10/1994 Goldstein ..... H02S 10/30 136/253
5,360,490 A * 11/1994 Nelson ..... F23D 14/12 136/253
5,380,192 A * 1/1995 Hamos ..... F23D 14/02 431/328
5,444,261 A * 8/1995 Kim ..... G06F 1/1601 250/493.1
5,476,375 A * 12/1995 Khinkis ..... F24H 1/40 431/7
5,500,054 A * 3/1996 Goldstein ..... H02S 10/30 136/246
5,566,607 A * 10/1996 Schleimer ..... A47J 37/0704 126/25 R
5,622,491 A * 4/1997 Van Belle ..... B01F 5/045 431/328
5,711,661 A * 1/1998 Kushch ..... F23D 14/12 431/326
5,749,721 A * 5/1998 Klinge ..... F23D 14/16 431/328
5,762,885 A * 6/1998 Debbage ..... B01D 53/8696 422/171
5,782,629 A * 7/1998 Lannutti ..... F23D 14/16 431/326
5,842,851 A * 12/1998 Pivot ..... F23D 14/18 431/328
5,879,473 A * 3/1999 Sarraf ..... H02S 10/30 136/253
5,993,192 A * 11/1999 Schmidt ..... F23D 14/18 431/12

(56) References Cited

U.S. PATENT DOCUMENTS 6,007,329 A * 12/1999 Meyer ..... F23D 14/14 431/326
6,159,001 A * 12/2000 Kushch ..... F23D 14/14 431/7
6,213,757 B1 * 4/2001 Kushch ..... F23D 14/12 431/7
6,257,868 B1 * 7/2001 Durst ..... F23C 99/006 431/11
6,354,831 B1 * 3/2002 Wilk, Jr ..... F23D 14/16 126/512
6,428,312 B1 * 8/2002 Smelcer ..... F23D 14/14 431/114
6,575,736 B1 * 6/2003 Aust ..... F23D 14/14 431/328
7,011,516 B2 * 3/2006 Aust ..... F23D 14/14 431/328
7,201,572 B2 * 4/2007 Wood ..... C04B 35/565 264/109
7,291,010 B2 * 11/2007 Perlo ..... F23C 13/00 431/170
9,291,346 B2 * 3/2016 Lenoir ..... F23D 14/14
9,709,265 B2 * 7/2017 Sutherland ..... F23C 99/006
2003/0054313 A1 * 3/2003 Rattner ..... F23D 14/16 431/326
2004/0132607 A1 * 7/2004 Wood ..... C04B 35/63 501/95.1
2005/0142512 A1 * 6/2005 Perlo ..... F23D 14/30 431/326
2008/0227044 A1 * 9/2008 Cookson ..... F23D 14/16 431/328
2010/0266972 A1 * 10/2010 Sullivan ..... F23D 14/14 431/329
2013/0273485 A1 * 10/2013 Lenoir ..... F23D 14/14 431/329
2015/0253005 A1 * 9/2015 Sutherland ..... F23C 99/006 431/328
2016/0003471 A1 * 1/2016 Karkow ..... F23D 14/78 431/2
2016/0024962 A1 * 1/2016 Luthra ..... C04B 41/5024 428/312.6
2016/0153288 A1 * 6/2016 Luthra ..... C04B 41/009 428/215
2016/0160664 A1 * 6/2016 Luthra ..... C04B 41/52 428/332
2016/0230986 A1 8/2016 Shmelev et al.

OTHER PUBLICATIONS

Russian Journal of Physical Chemistry B, 2010, vol. 4, No. 4, pp. 593-601 @Pleiades Publishing, Ltd. 2010 Original: Shmelev, V.M., "Combustion of Natural Gas at the Surface of a high-Porosity Metal Matrix," Chemical Physics, 2010, vol. 29, No. 7, pp. 27-36.
Kirdyashkin, A.I. et al., "Energy and spectral characteristics of the radiation in the process of filtration combustion of natural gas," SCF, 2010, vol. 46, No. 5, pp. 37-41 (English Abstract).
Vasiliki, N.Y., et al., "Formation of the ceramic coating of the multi-detonation unit," Combustion and Explosion, Torus Press, 2014. pp. 241-244 (English Abstract).
Shmelev, V.M., "Surface Burning on a Foam Metal Matrix with the Ceramic Coating," Combus. Sci. Technol., 2014, 186, pp. 943-952.
Wood, et al., Susie, "Porous Burners for Lean-burn Applicaitons," 2008 Progress in Energy and Combusion Science, 2008, 34, 667-684.
Kamal, M.M., et al., "Gambustian in porous media," J. PowerEnergy, IMechE Feb. 23, 2006, vol. 220, Part A, pp. 487-508.

* cited by examiner

Comparison between the coated and uncoated matrix surface (left) and the structure of the ceramic film (right)

The matrix surface temperature (1, 2) and its reverse side temperature (3, 4) from the power density for uncoated surface (2, 4) and coated surface (1, 3) at differenct power density (W) with excess air factor α =1.1. Points with a cross are from the ceramic coating matrix; points with the vertical line are from the initial uncoated matrix.

Flue gas CO and NOx corrected concentrations at different firing rate (α=1.1).

Flue gas CO and NOx corrected concentrations at different excess air ratio (W=33w/cm2).

RADIANT INFRARED GAS BURNER

CROSS REFERENCE TO RELATED APPLICATIONS

This application is a continuation-in-part application of U.S. patent application Ser. No. 15/016,469, filed on 5 Feb. 2016 and which parent patent application claims the benefit of U.S. Provisional Patent Application Ser. No. 62/113,868, filed on 9 Feb. 2015. Each of these cross referenced applications is hereby incorporated by reference herein in its entirety and made a part hereof, including but not limited to those portions which specifically appear hereinafter.

BACKGROUND OF THE INVENTION

Field of the Invention

This invention relates generally to pre-mix combustion technology. The invention can be used in and for the development of ecologically clean, compact, cost-effective heat generators and infrared radiators such as for use in numerous various applications in the residential, commercial, and industrial areas.

Description of Related Art

Surface Stabilized Combustion (SSC) of gaseous fuel oxidant mixtures on a permeable matrix can reduce emissions of flue gas pollutants (e.g., NOx, CO, UHC), increase radiation density, and increase thermal efficiency all of which factors are important to the design of advanced compact cost-effective radiation heating combustion devices. Through the effective utilization of SSC, radiation heat flux from the matrix surface can be increased up to 80% of the heat flux providing from 20 to 40% of the total energy released from combustion by infrared radiation. Such radiation enhancement is primarily due to surface combustion on the matrix. Based on intensive heat exchange between the combustion products and the matrix, the matrix surface is heated to high temperatures. The peak flame temperature and resulting combustion products temperature in the combustion zone is in turn reduced which reduces the corribustion products NOx concentration.

The distance between the combustion zone and the matrix surface is dependent on the thermal conductivity of the gas mixture exit layer of the matrix. With the gas mixture exit layer exhibiting a relatively high thermal conductivity, the flame is located at some distance from the matrix surface. In such case, most of the energy released by combustion is carried by the combustion products. A small part of the energy released by combustion is transferred to the permeable matrix. A portion of the heat transferred to the matrix is radiated to the load and a portion is transferred back to the gas mixture and stabilizes the surface combustion.

One existing method and apparatus for the SSC of fuel/oxidant gas mixtures involves SSC on a permeable matrix of particles of a heat-resistant metal alloy containing iron, chromium and aluminum. Refractory alloys containing aluminum are on the surface of the matrix. When heated in the presence of oxygen, a dense aluminum oxide film 1 micron in thickness is developed which prevents further oxidation of the surface and protects the surface from corrosion. However, such a thin film of aluminum oxide significantly affects only the chemical oxidation processes of the surface and has no significant effect on the heat exchange between the combustion products and the surface of the burner.

A device is known for the implementation of gas surface combustion on the outside surface of a sleeve of woven ceramic fibers. The sleeve is worn on a perforated metal carrier, through which the fuel/oxidant gas mixture is fed to the fabric sleeve. A disadvantage of this device is that the heating of the gas mixture while the gas mixture passes through the perforated metal carrier is insufficient to ignite (and maintain) combustion of the gas mixture. The sleeve of woven ceramic fibers substantially prevents heat transfer between the combustion products and the surface of the perforated metal carrier. Thus, an auxiliary triggering device is used to initiate (and maintain) combustion of the gas mixture over the outer surface of the woven ceramic fiber sleeve.

Another existing device burns gas on the surface of a thick layer of ceramic fibers and polymers deposited on the surface of a corrosion resistant mesh screen. The thickness of the layer of ceramic fibers and the polymers is selected to prevent corrosion heating of the mesh screen. The thickness of the layer of ceramic fibers and polymers is from 6.35 mm to 12.7 mm. A disadvantage of this device is the fact that during operation the gas mixture is preheated and burnt within the thick layer surface of ceramic fibers and polymers are burnt out and degrade.

Radiant infrared permeable matrix gas burners operate using the SSC principle when gaseous fuel premixed with oxidizer (e.g. air) is combusted on the surface of the permeable matrix. Compared to conventional combustion, such SSC processing occurs at a lower temperature, because of highly intense heat transfer from the reaction zone to the body of the matrix and surroundings. A portion of the thermal energy from the combustion zone is converted to infrared radiation from the surface of the matrix. This approach to combustion of gases has several advantages, mainly: i) ability to generate intense radiative energy flows that are highly desirable for many heating applications, and ii) reduction of nitrogen oxides (NOx) emissions by an order of magnitude. Extensive theoretical and experimental research is available on SSC of or for a flat matrix. However, there are significant shortcomings with SSC on a flat matrix, including low specific power (~30 W/cm$^2$), high carbon monoxide (CO) emissions, and a narrow stable operating range (limited turndown ratio).

As identified above, SSC on a permeable matrix desirably reduces NOx emissions during combustion of a gaseous fuel and increasing radiation energy flux density, which is of interest for the creation of environmentally friendly, compact heat generators and powerful sources of infrared radiation. With such combustion of a gaseous fuel in SSC mode, the fraction of the radiation energy from the surface of the permeable matrix is 20-40% of the total energy released during combustion. This is explained by the fact that the combustion of the gaseous fuel occurs at the surface of the matrix. Due to intensive heat transfer between the combustion products and the surface of the matrix in the SSC mode, the matrix surface is heated to a high temperature. As a result, the temperature of the combustion products in the combustion zone is decreased which leads to a reduced concentration of nitrogen oxides in the combustion products.

As identified above, there are known devices for SSC of gaseous fuel on the surface of a permeable element consisting of particles of a metal alloy containing iron, chromium and aluminum. To optimize the process of stabilized combustion, it is necessary to maintain a high rate of heat exchange of the gaseous fuel with the surface of the matrix. In the combustion zone, the heat flow from the combustion products to the surface must be maintained at a certain level to be sufficient for steady state SSC and limited to avoid or prevent flame quenching.

To increase burner efficiency, a reverberatory screen in the form of a metal mesh or metal perforated plate installed above the matrix surface has been used. The reverberatory screen is heated by combustion products and radiates to the matrix surface thus increasing its temperature and radiant heat flux from the matrix surface thus increasing combustion stability and reducing NOx and CO emissions.

An industrial burner realizing the described principles and achieving low NOx and CO emissions is known. The burner consists of an air-fuel mixer, a perforated plate for SSC, and light metal mesh reverberatory screen above the plate. It is shown that the screen increases surface temperature of the matrix. The distance between the reverberatory screen and the matrix surface is dependent on the height of the flame.

A disadvantage of such a radiant matrix burner with reverberatory screen is the relatively low effectiveness of the reverberatory screen. Moreover, inclusion and use of such a screen coated with a special ceramic foam significantly complicates fabrication of the burner.

Also known is a radiant burner containing a housing with a perforated plate (or radiation shield) and equipped with a radiating nozzle in the output section of the housing. A disadvantage of this type of burner is high hydraulic resistance which negatively affects combustion stability at low fuel pressure. Moreover, the radiation shield does not provide a reduction of carbon monoxide in the combustion products below 0.008% (80 ppm).

Another known device is a radiant burner containing two-layer matrix with different permeability. With or in such a burner, the gas mixture is burned in the volume of the upstream layer with a larger porosity. A result of the volumetric combustion is very high temperature of the matrix surface. This leads to a significant increase of the burner radiation efficiency. Common disadvantages of this type of burner is the complexity and high cost of manufacturing two-layer matrix. Such a burner requires the use of high temperature materials and a thicker matrix compared to existing one-layer burner designs. Further, the immersion of the flame front deeply into the matrix leads to overheating of the matrix and increased concentration of nitrogen oxides.

For these and other reasons, there is a need and a demand for new and improved burner designs that overcome at least some of these problems or shortcoming of previous burner designs.

SUMMARY OF THE INVENTION

One aspect of present invention involves the ability to redistribute the flows of heat released by burning of the gas mixtures, thereby increasing the temperature of the emitting surface of the matrix and thus increase the portion of the heat that is carried away from the permeable matrix in the form of radiation.

The subject method and apparatus, in accordance with selected embodiments, involves or includes starting the gas combustion process through pre-heating of the gas mixture as it moves through the permeable matrix. The proposed process may further include the utilization of a bulk permeable matrix formed from metal having high thermal conductivity which allows preheating the gas mixture to a temperature close to the temperature of ignition. The surface of the matrix and the surface of the pores and channels near the gas mixture exit of the matrix are preferably coated by or with a layer of material having a thermal conductivity several times reduced as compared to the thermal conductivity of the matrix material.

In accordance with one aspect of the invention, to optimize the SSC process, it is desirable to maintain a high rate of heat exchange between the pore and channel surfaces within the body of the matrix and the gas mixture as optimization of preheating of the mixture can desirably avoid flame extinction. In the combustion zone, the flow of heat from the combustion products to the surface is preferably maintained at a level to avoid the flame extinction providing steady state SSC. To optimize the combustion process and achieve enhanced SSC, the permeable matrix is preferably a combined matrix comprising a material with a high thermal conductivity (e.g., metal) coated with a material with a low thermal conductivity (e.g., ceramics).

Experiments have shown that with the flame immersed in the pores and channels of the ceramic coated side of the permeable matrix, both the heat flux from the combustion products to the coated side of the matrix and the surface temperature of the coated side of the matrix increase. Increasing the temperature of the matrix according to the Stefan-Boltzmann law leads to an increase in the energy flux emitted by the matrix surface. The possibility of stable operation of the burner in such conditions is determined by the thermal characteristics of the matrix material of the burner. The technology provides the formation of a ceramic coating such as of aluminum oxide on the surface of a matrix such as of highly permeable volumetric porous metal foam. In accordance with an aspect of the invention, one of the features of the subject method of forming coatings is the ability to apply dense ceramic coatings to a surface with high adhesion and at high speeds with minimal impact to the surface, thus allowing the coating to be applied to brittle surfaces. At the same time, the technology allows a high-speed application of ceramic powder particles to form a ceramic coating having a higher ductility as compared to those provided or resulting from other methods of application. The plasticity of such a resulting ceramic coating allows it to operate in a stable manner in or wider conditions of high temperature gradients. The optical transparency of the ceramic coating (e.g., alumina or zirconia) provides that at a coating thickness of 50 to 200 microns heat can effectively be dissipated by radiation from the combustion zone, dipping below the surface of the matrix. This is very important, since the emissivity of the metallic matrix is several times higher than that of the ceramic coating (e.g., alumina or zirconia), providing significantly higher radiation flux.

The invention, in accordance with specific particular embodiments, comprises or involves significant features not previously known. For example, particular embodiments of the invention may desirably employ or involve the application and/or use of a thick coating: having a low coefficient of thermal conductivity and transparent in the infrared wavelength range, and having high ductility at the working surface of the burner and on the surface of the pores or channels of the matrix near the outlet of the gas mixture. These features combine to increase the temperature and the flux of radiant energy from the metallic matrix and to increase the strength and the service life of the burner, increase burner efficiency and reduce pollutant emissions.

Another aspect of the present development relates to a radiant infrared gas burner device. In accordance with one embodiment, a radiant infrared permeable matrix gas burner operates using the surface stabilized combustion (SSC)

principle when gaseous fuel premixed with oxidizer (e.g., air) is combusted on the surface of the permeable matrix.

One aspect of present invention involves the ability to redistribute the flows of heat released by the burning of the gas mixtures, thereby increasing the temperature of the emitting surface of the matrix and thus increase the portion of the heat that is carried away from the permeable matrix in the form of radiation. The temperature of the combustion products is reduced which leads to reduced NOx emissions in the combustion products and an extended range of stable combustion.

A subject method and apparatus, in accordance with selected embodiments, include or involve preheating of the gas mixture (e.g., gaseous fuel and oxidizer/air) during movement (flow) of the mixture through the permeable matrix. A distinctive feature of at least certain embodiments the present invention is the heating of the gas mixture to even a higher temperature due to the heat recovery from the combustion products into the body of the matrix by means of the inclusion and use of thermal elements in thermal transfer communication with the matrix, as well as additional radiation heating of the matrix surface from the radiation of the surfaces of thermal elements located in the region of the combustion products. In selected embodiments, the thermal elements take the form of thermal conductive elements such as disposed to at least partially penetrate the matrix.

In accordance with selected embodiments, the matrix is an assembly of bars of highly porous metal or metal alloy (e.g., FeCrAl or FeCrAlY) foam or pressed wire and thermal elements, e.g., thermal conductive elements (recuperators), in the form of plates (or rods, fins, etc.) such as made of high temperature and high conductivity material and such as desirably at least partially protruded above the matrix surface. Placing thermal conductive elements in the matrix has made it possible to provide additional convective-radiation heat recovery from combustion products to the matrix. The surface temperature of the matrix with thermal conductive elements is increased by more than 200K, as a result, the maximum value of radiation flux density from the matrix surface is increased by 1.7 times. The SSC mode on the matrix with heat recuperation can be realized in a wider range of combustion/burner power density values as compared to conventional radiant infrared permeable matrix gas burner, namely, the upper limit of the range is extended from 45 W/cm$^2$ to 120 W/cm$^2$. The concentration of carbon monoxide in the combustion products is decreased by more than twofold, the concentration of nitrogen, oxides is decreased by 1.5 times in the matrix with heat recuperation.

Aspects of the invention include a unique new feature of the radiant infrared permeable matrix burner such as radiative-convective-conductive heat transfer to the body and to the surface of the matrix by means of high temperature steel thermal elements, e.g., thermal conductive elements. This feature allows increasing the temperature of the matrix and the radiation energy flux from the matrix, expanding the area of stable combustion, improving robustness and increasing efficiency of the burner device, and also reducing the concentration of toxic components in the combustion products.

With selected embodiments of the subject method of gaseous fuel combustion on the surface of permeable matrix, one or more of the following can be realized: extended region of stable combustion, increased amount of energy emitted by the heated matrix surface, reduced concentration of toxic components in the combustion products, preheating of the gas mixture when it flows through the matrix channels or pores, higher temperature of the matrix due to thermal conductive elements inserted into the body of the matrix and transferring heat downstream of the matrix body, additional heat transferred to the matrix surface by radiation from the surface of thermal elements located in combustion zone. To expand the area of sustainable combustion, i.e., to achieve high values of combustion power density on the matrix surface, it is necessary to supply the combustible gas mixture through the matrix with a specific high flow rate or high velocity of the gas medium under conditions of high porosity and matrix permeability. However, as matrix porosity increases, the effective thermal conductivity of the matrix material decreases. Combustion of the gaseous fuel according to embodiments of the proposed method can be characterized in that by introducing thermal conducting elements into the body of the matrix, additional heat is supplied to the body and surface of the permeable matrix. More intense heat transfer between the matrix and air-gas mixture flowing through the matrix leads to an increased temperature of the gas mixture at the matrix exit, and as a result, to a potentially higher combustion power density of the burner. As the surface temperature of the matrix increases when burner power density is increased, the temperature of the combustion products decreases, which is unusual and not obvious. Conducted experimental results have shown that in this case the concentrations of NOx and CO emissions in combustion products are decreased. An increased surface temperature of the matrix in accordance with the Stefan-Boltzmann law leads to an increased energy flux radiated by the surface. A decreased temperature of the combustion products leads to a decreased energy flux by the combustion products. The energy released during the combustion of the gaseous fuel is redistributed in such a way that the amount of radiation energy emitted by the burner is increased, the amount of energy carried away by the combustion products is decreased. A decreased temperature of the combustion products leads to a decreased concentration of nitrogen oxides in the products. The decreased concentration of carbon monoxide under these conditions can be explained by the larger residence time of the combustion products in the high temperature zone in the space between the thermal conductive elements over the matrix surface and more complete oxidation of carbon monoxide.

DETAILED DESCRIPTION

Figures 1A, 1B:
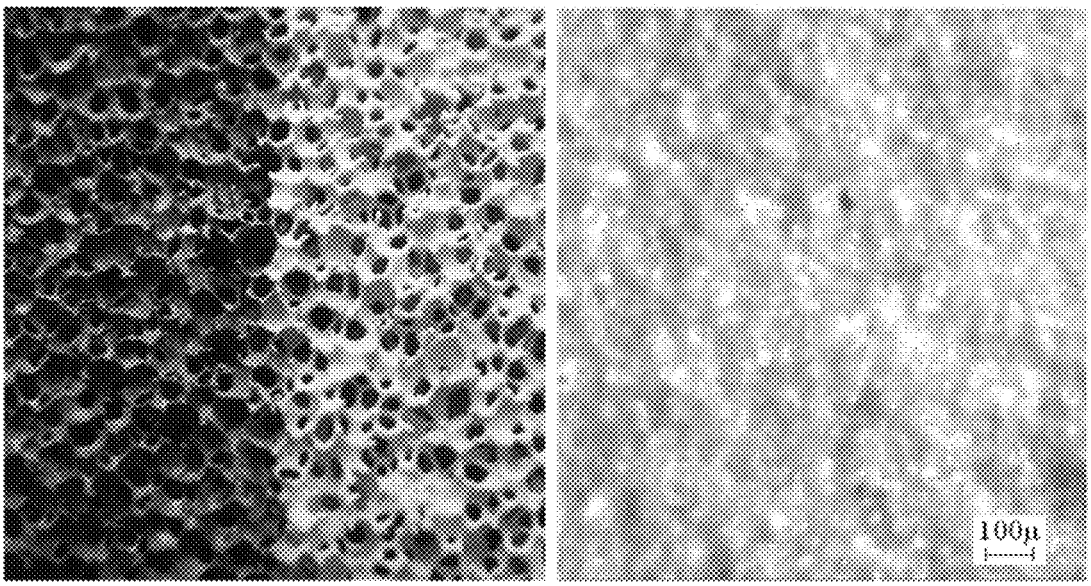
FIG. 1A is a comparative image between a coated and an uncoated matrix surface.
FIG. 1B is an image showing the structure of a ceramic film.

In accordance with one embodiment, there is provided a method of burning combustible gas mixtures on the surface of the permeable matrix with increasing amounts of radiation energy emitted by or from the heated surface of the matrix and decreasing the emission concentration of undesirable species, such as pollutants, such as nitrogen oxide, in the combustion products. Preheat of the fuel/oxidant gas mixture is preferably carried out as the gas mixture moves through the pores and channels of the permeable matrix. Combustion of the gas mixture near the surface of the permeable matrix by the method is preferably provided by introducing between the combustion products and the surface of the matrix, matrix pores and channels surfaces near the combustion products exit a material with a thermal conductivity significantly lower than that of the matrix base material, and by transfer of the combustion zone to the surface of the pores and channels of the permeable matrix at the gas mixture exit. Heat exchange between the combustion products and the matrix base material is preferably carried out through a large contact area of the flame and the walls of the pores and channels. Experiments have shown that moving the region of the combustion zone to under the surface of the permeable matrix increases the surface temperature and reduces the temperature of combustion, as well as reduces the concentration of nitrogen oxides and carbon monoxide in the combustion products. Increasing the temperature of the burner according to the Stefan-Boltzmann law leads to an increase in the radiation energy flux emitted by the matrix surface; decreasing the temperature of the combustion products and leading to a decrease of the energy carried away by the combustion products.

The energy released during the combustion of the gas mixture is preferably distributed so that the amount of radiation energy emitted by the burner increases, and the amount of energy carried away by the combustion products is reduced. Heat dissipation by radiation from the surface of the matrix base material coated with the layer is carried out through the material (ceramic) matrix on the surface that is transparent to IR radiation. Effective heat radiation is achieved with a coating material having a high transparency in the infrared spectrum. In experiments, coating materials of alumina and zirconia were successfully utilized at or with coating thicknesses of 50 to 200 microns. Moving the combustion zone to below or under the surface of the matrix reduces the flame temperature which in accordance with the laws of chemical kinetics results in a decrease in the concentration of nitrogen oxides in the combustion products. Further, the concentration of carbon monoxide can desirably be reduced under these conditions, such reduction at least in part attributable to an increase in the residence time within the combustion zone of a high temperature and a more complete oxidation of carbon monoxide.

In accordance with selected preferred embodiments, the thickness of the high thermal conductivity permeable matrix base material is at least 5 millimeters.

In accordance with selected preferred embodiments, the thickness of the high thermal conductivity permeable matrix base material is no more than 30 millimeters.

In accordance with selected preferred embodiments, the thickness of the coating of a low thermal conductivity high optical transmittance material is at least 10 micrometers.

In accordance with selected preferred embodiments, the thickness of the coating of a low thermal conductivity high optical transmittance material is no more than 500 micrometers.

In accordance with selected preferred embodiments, the ratio of the thermal conductivity of the matrix base material to the thermal conductivity of the coating layer material is at least 3.

In accordance with selected preferred embodiments, the ratio of the thermal conductivity of the matrix base material to the thermal conductivity of the coating layer material is no more than 10.

The heat flux density per permeable matrix radiation surface area provided by a burner, in accordance with selected preferred embodiments, is at least 5 $w/cm^2$.

The heat flux density per permeable matrix radiation surface area provided by a burner, in accordance with selected preferred embodiments, is no more than 200 $w/cm^2$.

In accordance with selected preferred embodiments, the permeable matrix material comprises a metal material, a cermet material or a combination thereof.

In accordance with selected preferred embodiments, the permeable matrix material is chromal, kanthal, heat-resistant steel, carbide of a titanium, aluminum, iron, chromium, yttrium or a combination of two or more of such materials.

Those skilled in the art and guided by the teachings herein provided will understand and appreciate that methods of burning combustible gas mixtures on the surface of a permeable matrix providing surface stabilized combustion (SSC) as herein provided desirably produce or result in increasing amounts of radiation energy emitted by the hot surface of the permeable matrix and decreasing concentrations of toxic components in the combustion products.

METHOD EXAMPLE

Experiments to test the effectiveness of the invention were carried out on a burner with an array of highly permeable metal foam (PMF) having a thickness of 14 mm, a bulk porosity and surface permeability corresponding to 0.9 to 0.4. The matrix was of a material called Chromal. On the surface of the matrix, a coating of ceramic aluminum oxide with a thickness of 200 microns was applied (see FIG. 1) via the gas dynamic method and using a multichamber detonation unit. The starting material utilized in the coating powder was AMPERIT 740.0 $Al_2O_3$, procured from H.C. Starck GmbH. The coefficient of thermal conductivity of the coating material is less than six times the coefficient of the thermal conductivity of the matrix material. Tests were carried out with mixtures of natural gas and air at a heat-density of 20 W/cm$^2$ to 80 W/cm$^2$, and changes in the excess air ratio ranging from 1.0 to 1.4. Under all the experimental conditions performed with the matrix, with a coating of aluminum oxide, a change of the surface combustion mode was observed. On coated matrices, the flame front was submerged beneath the surface of the matrix, the matrix surface temperature increased and the concentration of nitrogen oxides and carbon monoxide in the combustion products decreased.

Figure 2:
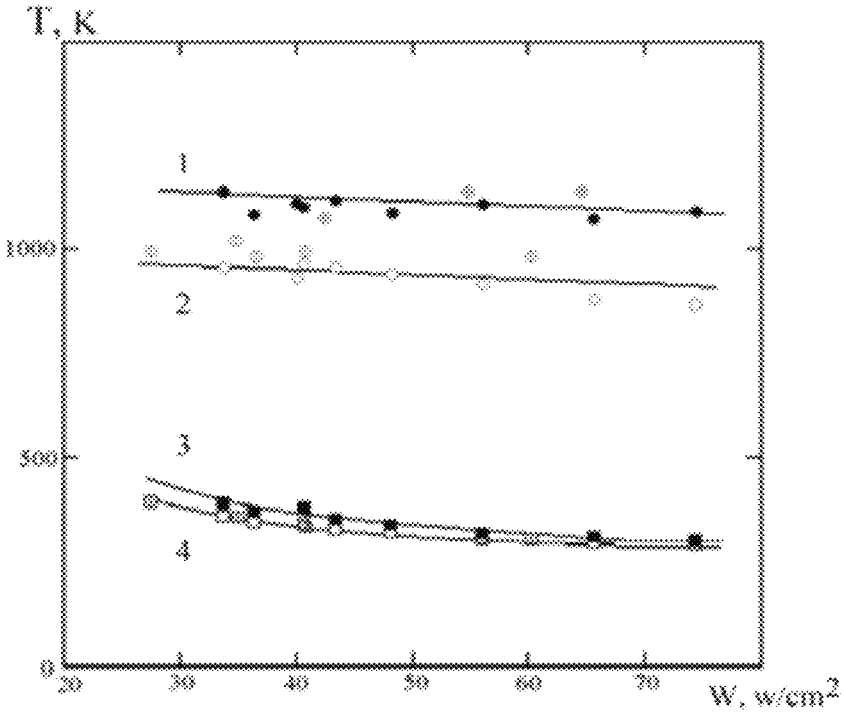
FIG. 2 is a graphical representation of matrix surface temperature and its reverse side temperature for coated and uncoated surfaces versus combustion power densities (W) at an excess air factor, $\alpha$=1.1.
Figure 3:
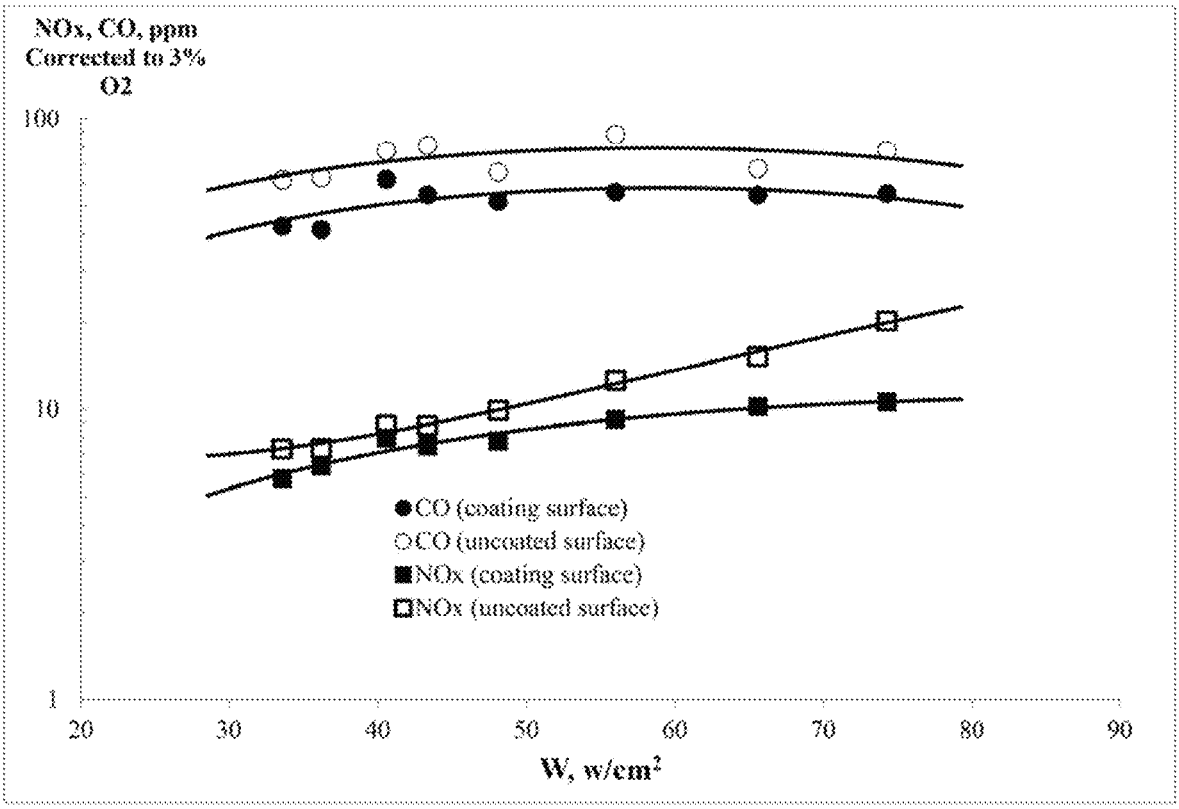
FIG. 3 is a graphical representation of corrected flue gas NOx and CO concentrations versus combustion power density (W) at $\alpha$=1.1.
Figure 4:
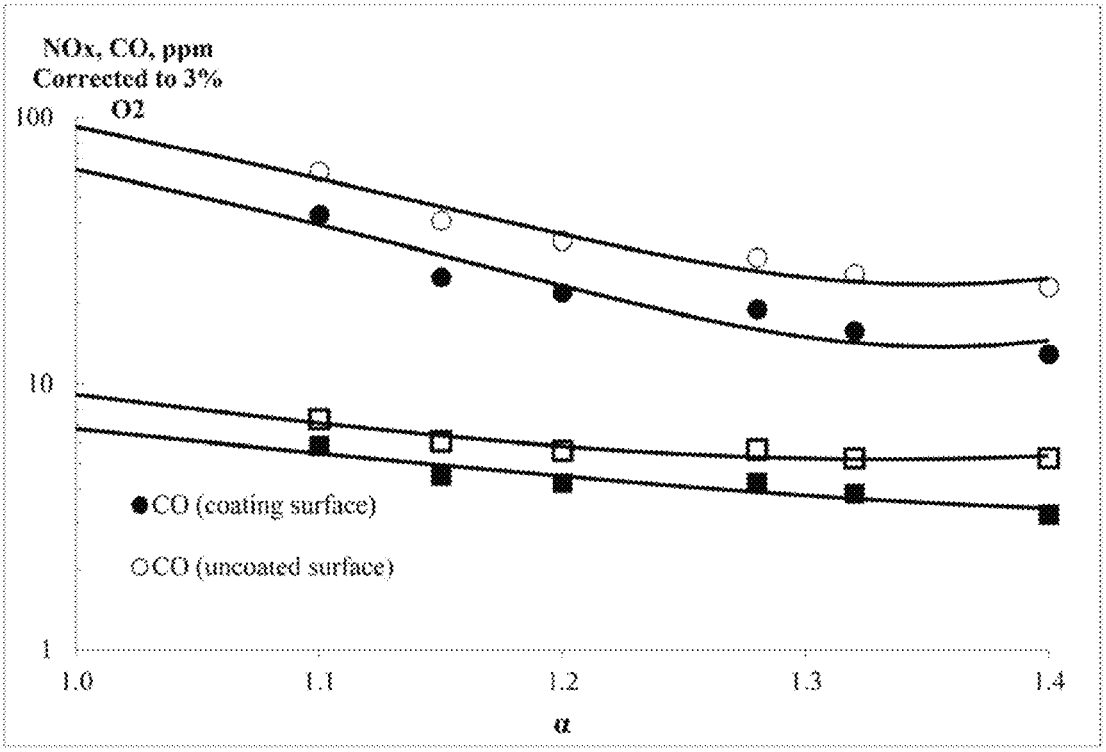
FIG. 4 is a graphical representation of corrected flue gas NOx and CO concentrations versus excess air ratios at a combustion power density (W)=33 W/cm$^2$.

The surface temperatures and concentrations of nitric oxide and carbon monoxide in the combustion products are shown in FIGS. 2, 3 and 4. Experiments have demonstrated the effectiveness of the invention. The temperature of the mold surface with a ceramic coating over the entire range of parameters was about 200 K higher than the temperature of the uncoated matrix. The radiation flux from the coated matrix was two (2) times greater as compared to that of the uncoated matrix. The increase in the radiation flux was accompanied by a decrease in combustion temperature of the combustion products, which reduced the concentration of nitrogen oxides. Under conditions of high heat load (e.g., 80 W/cm$^2$), the concentration of nitrogen oxides in the combustion products for the ceramic-coated matrix was up to two (2) times less than for the uncoated matrix. The concentration of carbon monoxide for matrices with a ceramic coating was approximately one-third (⅓) less than for uncoated matrices.

Figure 5:
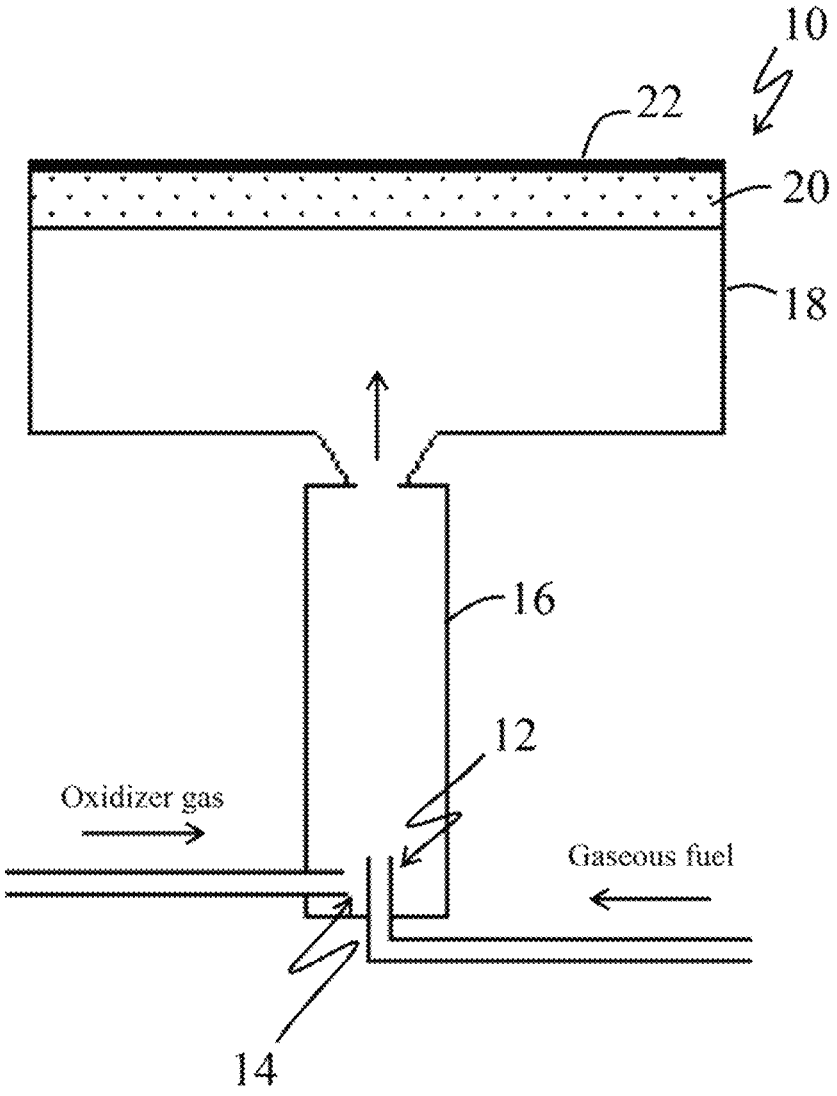
FIG. 5 is a simplified schematic showing a premix burner in accordance with one embodiment of the invention.

Turning to FIG. 5, there is shown a premix burner assembly generally designated by the reference numeral 10, in accordance with one embodiment of the invention. The burner assembly 10 of the invention preferably includes a mixer 16 for mixing gaseous fuel and oxidizer gas with a fuel inlet for receiving a gaseous fuel; and an oxidizer inlet for receiving an oxidizer gas, resulting in production a gas mixture. The burner 10 further includes high thermal conductivity permeable matrix base material 20 to provide surface stabilized combustion at the exit of the mixture by or from the pores and channels. The base material is preferably coated by the layer of the low thermal conductivity material 22 having high optical transmittance in the infrared spectrum. The burner 10 of the subject invention preferably results in embedded combustion located between the high thermal conductivity base material 20 and the low thermal conductivity material 22.

The combustible gas mixture burner assembly 10 is a high-infrared radiation ultra-low pollutants emission pre-mixed gas burner assembly that includes a fuel inlet 12 for receiving a gaseous fuel; an oxidizer inlet 14 for receiving an oxidizer gas; a chamber 16, e.g., a mixer or mixing chamber, to ensure that gaseous fuel and oxidizer are produced into a proper combustible gas mixture; a burner device 18 to which the combustible fuel-oxidizer mixture is introduced and including or having a high thermal conductivity permeable matrix base material 20 providing surface stabilized combustion at the pores and channels of the boundary exit of this mixture to base material coat layered 22 with low thermal conductivity material having high optical transmittance in the infrared spectrum.

As detailed herein, a novel burner design in accordance with at least one embodiment of the invention is based, at least in part, on the ceramic coating of the combustion surface of a metallic permeable matrix. The ceramic, coating can desirably function or otherwise serve to achieve or realize one or more of the following: increased energy recuperation or recovery inside the matrix; increased heat transfer to the load; increased thermal efficiency; improved or higher combustion stability; decreased peak flame temperature; and reduced emissions of undesirable species such as NOx, CO, and unburned hydrocarbons (UHC).

In accordance with one embodiment of the invention, a gas burner device or assembly desirably includes a fuel inlet for receiving a gaseous fuel; an oxidizer inlet for receiving an oxidizer gas; a mixer for mixing gaseous fuel and oxidizer gas to produce a combustible gas mixture; a high thermal conductivity permeable matrix base material to provide surface stabilized combustion at the exit of the mixture by or from the pores and channels of the base material which is coated by the layer of the low thermal conductivity material have high optical transmittance in the infrared spectrum.

In accordance with another embodiment of the invention, a gas burner device or assembly desirably includes a fuel inlet for receiving a gaseous fuel; an oxidizer inlet for receiving an oxidizer gas; a chamber to ensure that gaseous fuel and oxidizer are produced into a proper combustible gas mixture; a high thermal conductivity permeable matrix base material providing surface stabilized combustion at pores and/or channels of or at the boundary exit of the mixture to base material coat layered with low thermal conductivity material having high optical transmittance in the infrared spectrum.

Such gas burner devices can be characterized as a high-infrared radiation ultra-low pollutants emission pre-mixed gas burners. Such gas burners can desirably achieve NOx levels below 3 vppm, CO levels below 5 vppm and UHC levels below 3 vppm, at desirably high thermal efficiency, at excess air ratio of below 1.05. Further such burners can desirably achieve stable operation under a wide range of excess oxidant rations (e.g., 0.1 to 4.0, for example). Ultra-low emission high efficiency gas-fired burners are very important in many residential, commercial and industrial applications.

Figure 7:
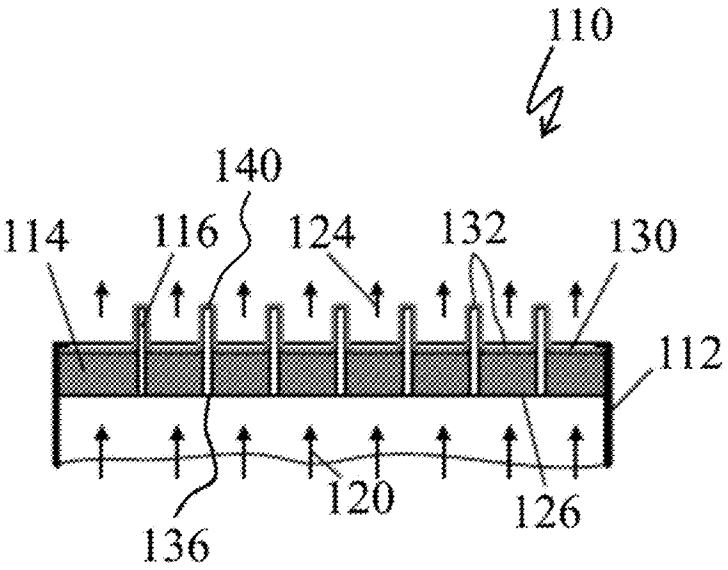
FIG. 7 is cross-sectional view of the burner assembly shown in FIG. 6 and taken along the line 7-7 of FIG. 6.
Figure 6:
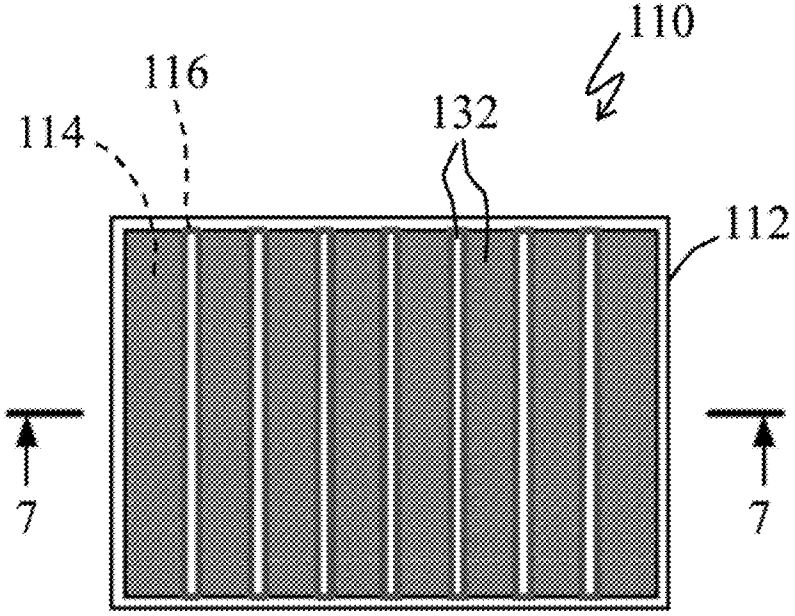
FIG. 6 is a plan side view of a simplified burner assembly in accordance with one embodiment of the invention.

FIGS. 6 and 7 illustrate a simplified burner assembly 110 in accordance with one embodiment of the invention.

The burner assembly 110 includes a generally rectangular burner housing 112, and a high thermal conductivity permeable matrix base material 114 to provide surface stabilized combustion at the exit of a combustible gas mixture of fuel and oxidizer by or from the pores and channels in the permeable matrix 114.

The permeable matrix 114 includes, at least partially contains or has associated therewith a plurality of thermal elements 116 such as in the form of thermal conductive elements. As will be appreciated by those skilled in the art and guided by the teachings herein provided, the broader practice of the invention is not necessarily limited by or to the use of thermal elements of specific shape or form or of specific materials or compositions. In accordance with selected preferred embodiments, however, the thermal elements desirably comprise a high temperature metal or metal alloy material such as stainless steel, heat-resistant steel, graphite, chromium, iron, iridium, lithium, nickel, Inconel® or Hastelloy® nickel-based alloy, and combinations thereof.

In such and similar embodiments, the thermal elements can be desirably spaced apart from adjacent thermal elements by a distance between 2 millimeters and 60 millimeters and, in some preferred embodiments the spacing between adjacent thermal elements is in a range of 5 millimeters to 15 millimeters.

Further, in accordance with certain preferred embodiments, the thickness of the permeable matrix base material is desirably in a range of from 5 millimeters to 30 millimeters and the thickness of the thermal elements are in a range of from 0.1 millimeters to 5 millimeters.

Further, in accordance with certain preferred embodiments, the thermal elements extend or protrude beyond the downstream surface of the matrix for a length equal to 0.5-5 of the distance between elements. In particular embodiments, the thermal elements extend or protrude beyond the downstream surface of the matrix for a length of 5 to 15 millimeters.

A gaseous fuel combustible mixture stream 120 is fed to or introduced to the burner assembly 110 with the burner assembly 110 acting thereon to produce or result in combustion products stream 124. More specifically, the gaseous fuel combustible mixture stream 120 is fed to or introduced to the permeable matrix 114 such as at matrix upstream surface 126.

Similar to some embodiments described above, the permeable matrix 114 can, if desired, be coated such as on a downstream surface 130 thereof by a layer of a low thermal conductivity material 132 having high optical transmittance in the infrared spectrum such as described above. If desired, and as shown, downstream exposed or protruding surfaces or portions of the thermal conductive elements 116 can in whole or in part be similarly coated with the a low thermal conductivity material 132.

In the burner assembly 110, the thermal elements 116 are at least partially disposed in the permeable matrix base material 114. More specifically, the thermal elements 116 include a base end 136 flush with the upstream matrix surface 126 and a free end 140, generally opposite the base end 136, and protruding or extending beyond the downstream matrix surface 130.

Operation of the radiant infrared gas burner assembly 110 is based on volumetric surface stabilized combustion (SSC) using a permeable matrix burner with thermal conductive elements. The volumetric nature of the burner is based at least in part on a 3D design that combines the permeable metal matrix design with thermal conductive elements made of highly thermally conductive material. As shown, a mixture 120 of gaseous fuel (e.g., natural gas) and oxidizer (e.g., air) is fed to the burner assembly 110 composed of a permeable metal matrix 114 (e.g., foam, mesh, pressed wire, etc. composed of a high temperature metal or metal alloy) in the burner housing 112. The mixture is pre-heated as it travels through the bulk body of the matrix. The heated gas mixture is then combusted within or near the exit pores and/or channels at the surface 130 of the permeable matrix material. The matrix surface 130 can be coated with a thin layer of ceramic material 132 (e.g., aluminum oxide) that has a thermal conductivity significantly lower than the thermal conductivity of the material forming the matrix and has a high optical transmittance in the infrared spectrum. Metallic thermal conductive elements 116 such as also made of a high temperature alloy and such as can penetrate into the bulk volume of the burner matrix 114 are added for radiative-convective-conductive heat recuperation of energy from the products of combustion 124 to the matrix body and gaseous fuel-air mixture. The thermal conductive elements 116 can be suitably prepared, formed, or constructed such as in a variety of shapes or forms such as tailored to a specific or particular application. Thus, while the broader practice of the invention is not necessarily limited by or to the shape or form of the thermal conductive elements, in accordance with particular embodiments thermal conductive elements in the shape or form of plates, rods, bars, rings, fins and combinations thereof, for example can be utilized.

In such embodiments wherein the matrix combustion surface is at least in part coated with a coating material, the coating material having a thermal conductivity less than the permeable matrix material thermal conductivity and is optically transparent to 1R radiation, the surface of the permeable matrix base material at least in part coated with the coating material desirably emits an increased amount of radiation energy and a decreased concentration of pollutant components in the combustion products as compared to the permeable matrix base material without the coating material.

Figure 9:
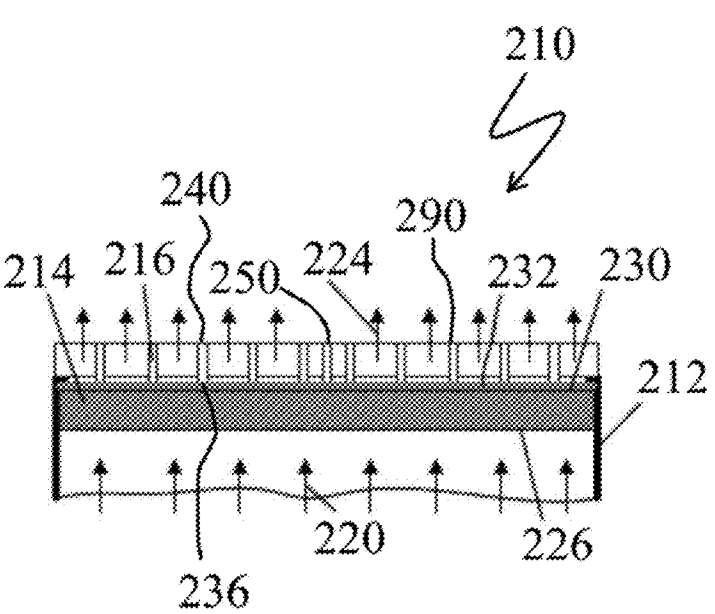
FIG. 9 is cross-sectional view of the burner assembly shown in FIG. 8 and taken along the line 9-9 of FIG. 8.
Figure 8:
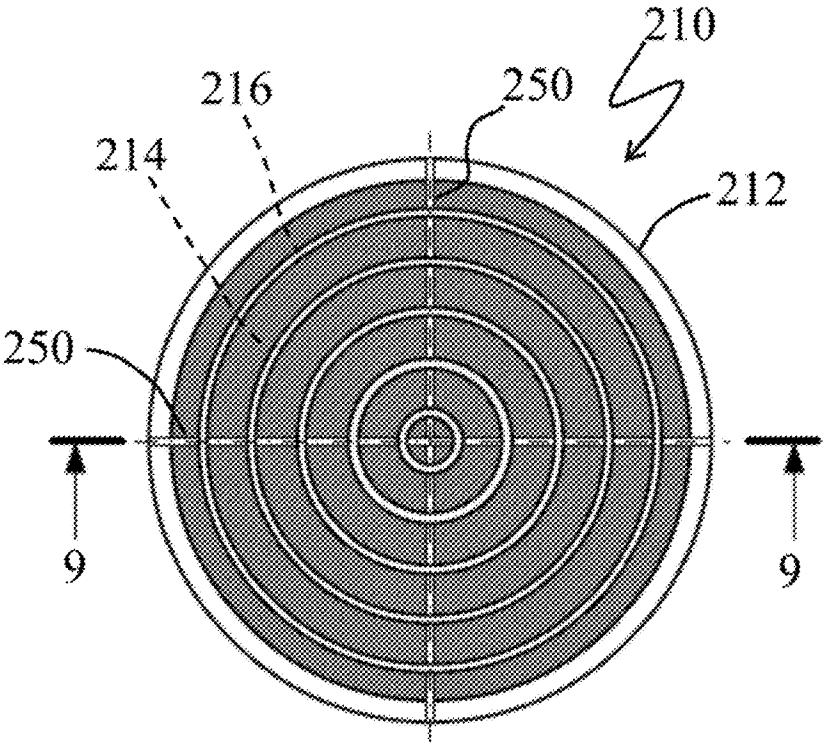
FIG. 8 is a plan side view of a simplified burner assembly in accordance with one embodiment of the invention.

FIGS. 8 and 9 illustrate a burner assembly 210 in accordance with another embodiment of the invention.

The burner assembly 210 includes a generally circular burner housing 212 and a high thermal conductivity permeable matrix base material 214 to provide surface stabilized combustion at the exit of a combustible gas mixture of fuel and oxidizer by or from the pores and channels in the permeable matrix 214.

The permeable matrix 214 includes, at least partially contains or has associated therewith a plurality of thermal elements 216.

Similar to the above-described burner assembly 110, a gaseous fuel combustible mixture stream 220 is fed to or introduced to the burner assembly 210 with the burner assembly 210 acting thereon to produce or result in combustion products stream 224. More specifically, the gaseous fuel combustible mixture stream 220 is fed to or introduced to the permeable matrix 214 such as at matrix upstream surface 226.

Similar to some embodiments described above, the permeable matrix 214 can, if desired, be coated such as on a downstream surface 230 thereof by a layer of a low thermal conductivity material 232 having high optical transmittance in the infrared spectrum such as described above.

In the burner assembly 210, the thermal elements 216 rather than being partially disposed in the permeable matrix base material are disposed adjacent the permeable matrix base material 214, more specifically, adjacent the downstream matrix surface 230. In this particular embodiment, the thermal elements 216 are spaced apart from the adjacent downstream matrix surface 230 at least in part by the width of the layer of a low thermal conductivity coating material 232. Thus, as shown in FIG. 9, the base ends 236 of the thermal elements 216 are desirably directly adjacent the layer of the coating material 232. As with the thermal elements 116 in the burner assembly 110, the thermal elements 216 include a free end 240, generally opposite the base end 236, and protruding or extending beyond the downstream matrix surface 230.

In the burner assembly 210 the thermal elements 216 are retained or held in desired position relative to the permeable matrix 214 by support structures 250 joined, connected or otherwise forming a part or portion of the burner housing 212. Moreover, in this embodiment, no coating of low thermal conductivity material having high optical transmittance in the infrared spectrum such as described above, is applied onto the thermal conductive elements 216.

Figure 11:
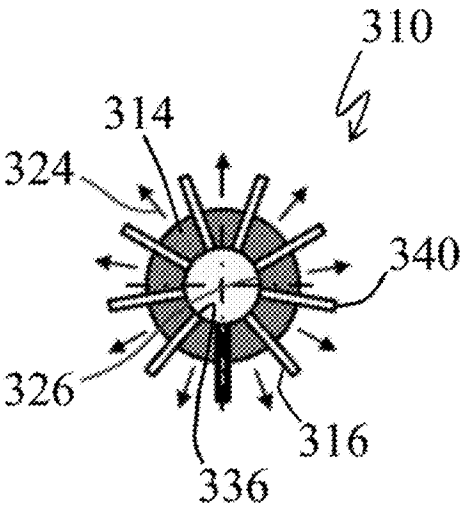
FIG. 11 is cross-sectional view of the burner assembly shown in FIG. 10 and taken along the line 10-10 of FIG. 10
Figure 10:
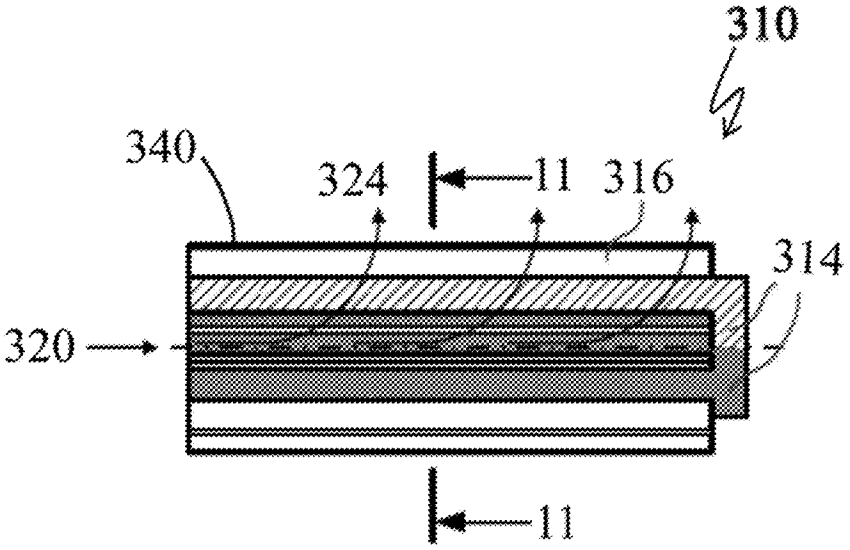
FIG. 10 is a partial cross-sectional side view of a simplified burner assembly in accordance with one embodiment of the invention.

FIGS. 10 and 11 illustrate a burner assembly 310 in accordance with yet another embodiment of the invention.

The burner assembly 310 includes a generally cylindrical high thermal conductivity permeable matrix base material 314 to provide surface stabilized combustion at the exit of a combustible gas mixture of fuel and oxidizer by or from the pores and channels in the permeable matrix 314.

The permeable matrix 314 includes, at least partially contains or has associated therewith a plurality of thermal elements 316.

A gaseous fuel combustible mixture stream 320 is fed to or introduced to the burner assembly 310 with the burner assembly 310 acting thereon to produce or result in combustion products stream 324. More specifically, the gaseous fuel combustible mixture stream 320 is fed to or introduced to the permeable matrix 314 such as at matrix upstream surface 326.

In the burner assembly 310, the thermal elements 316 are at least partially disposed in the permeable matrix base material 314. More specifically, the thermal elements 316 include a base end 336 flush with the upstream matrix surface 326 and a free end 340, generally opposite the base end 336, and protruding or extending beyond the downstream matrix surface 330.

It is to be understood and appreciated that the burner assemblies 110, 210 and 310, similar to the burner assembly 10 shown in FIG. 5 and described above, may each further include a fuel inlet for receiving a gaseous fuel; an oxidizer inlet for receiving an oxidizer gas; and a chamber, e.g., a mixer or mixing chamber, to ensure that gaseous fuel and oxidizer are produced into a proper combustible gas mixture.

Experimental Support

Unlike a conventional infrared burner with a reverberatory screen installed above the surface of the flat matrix for energy recovery by radiation to the combustion surface of the matrix, the burner assembly of the present invention provides radiative-convective-conductive heat recovery from the products of combustion to the matrix surface and to its body. Initial analytical modeling and laboratory testing have shown that radiative-convective-conductive heat recuperation by the thermal conductive elements is significantly more effective than radiation recuperation by a conventional reverberatory screen, potentially able to achieve combustion burner power density of 110 W/cm$^2$.

Figure 12A:
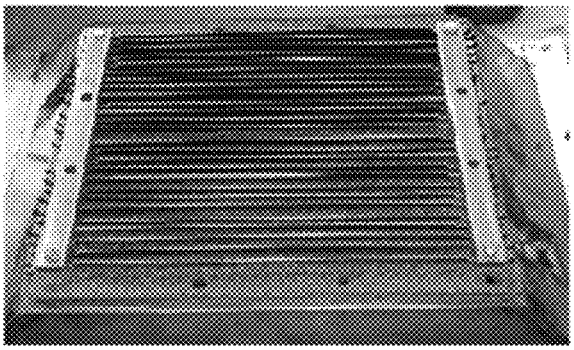
FIGS. 12A and 12B illustrate a tested prototype of radiant infrared matrix burner assemblies with thermal conductive elements in accordance with one embodiment of the subject development.
Figure 12B:
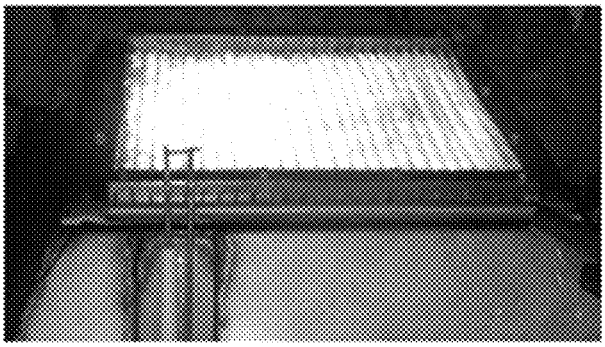

In the experiments, the characteristics of SSC for flat conventional matrix and present volumetric matrix with thermal conductive elements were compared. The layout of the present matrix and the photograph are shown in FIGS. 12A and 12B. The matrices were assembled from permeable metal foam bars.

Highly porous chromal foam (porosity 0.87-0.9) with a section of 8×8 mm, a length of 80 mm was used as matrix. Stainless steel plates of 0.2 mm, 0.7 mm or 1.3 mm thick were used as thermal conductive elements incorporated in the matrix body. The height of the plates was 16 mm and the length was 80 mm. The bottom end faces of the plates were flush to the foam bars. The top end faces of the plates were protruded 8 mm above the foam barbs. The matrices were located horizontally in the burner housing. A gas mixture of natural gas and air was fed from the bottom of the matrix Natural gas and air flow rates were measured using Bronkhorst flow meters. Combustion occurred on the top surface of the matrix. The temperature of the top surface of the matrix and radiation from the matrix in the 8-14 μm region were measured using an infrared pyrometer AR882. The temperature of the bottom side of the matrix was measured using a chromel-alumel thermocouple. Composition of the combustion products was determined using a Testo 335 gas analyzer. Total radiation flux density from the matrix was measured using a pyrometric sensor IRA710ST1 in the spectral range from visible to 14 μm. The thermal conductive element plates during combustion were heated due to convective heat transfer with combustion products and radiation from the surface of the matrix, as well as radiation of combustion products. Since the thermal conductivity of the material of the plates is an order of magnitude higher than the thermal conductivity of the porous foam material, one could expect an effective supply of additional heat to the matrix body.

The experiments were carried out using flat matrices of four types: conventional matrices of chromal foam of 8 mm thickness, as well as the matrix with thermal conductive plates introduced by the present invention. To increase the lifetime of the matrix at high temperature, the surfaces of some of the conventional and new matrices were covered with a thin layer of aluminum oxide (ceramic). A coating of alumina with thickness of 20 μm was applied on the surfaces of the matrices using a multi-chamber detonation plant. Experiments have shown that a stable surface combustion mode in the new matrix is realized in a wider range of values of combustion power density in comparison with conventional matrices. The combustion power density is the ratio of the burner firing (W) to the surface area of the matrix with combustion. Stable surface combustion in the new matrix with an excess air factor $\alpha$=1.1 is realized in the range of combustion power density from 15 W/cm$^2$ to 100 W/cm$^2$. For the conventional uncoated matrix, the range of combustion power density was from 20 W/cm$^2$ to 70 W/cm$^2$ (see FIG. 13). Expansion of the region of stable combustion (>100 W/cm2) with a change in the combustion power density is explained by increased burning rate of the mixture due to its additional heating in the matrix body.

Figure 13:
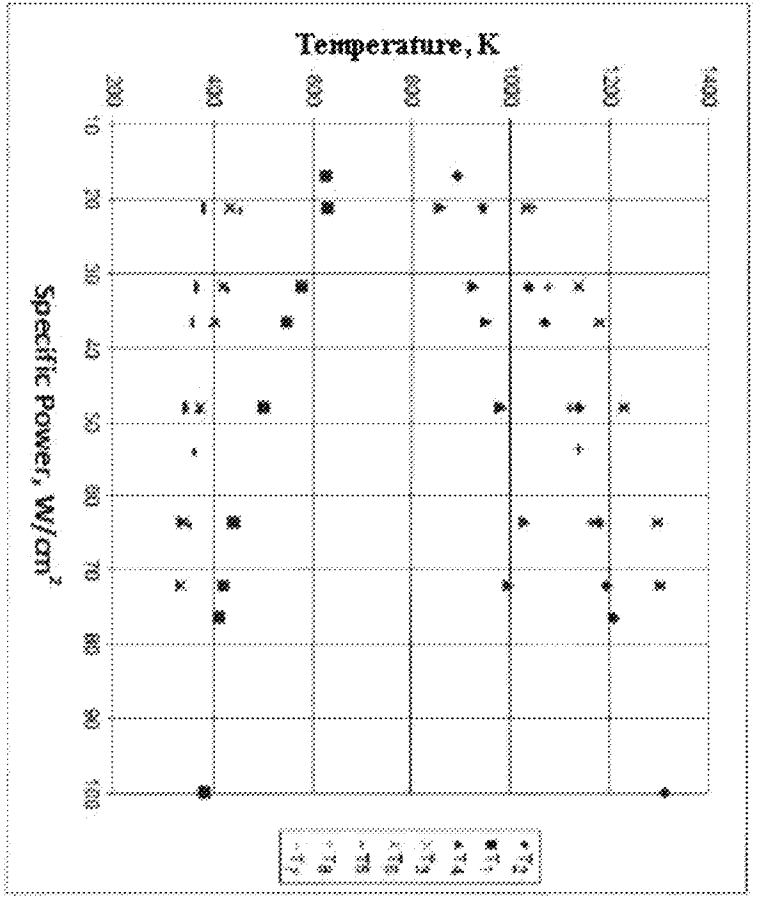
FIG. 13 is a graphical representation of surface temperatures versus burner power density for different types of matrixes in accordance with one embodiment of the subject development.

FIG. 13 is a graphical presentation of surface temperatures versus burner power density for different types of matrixes in accordance with one embodiment of the subject development. In FIG. 13, surface temperatures on the upstream (T1, T3, T5, T7) and downstream (T2, T4, T6, T8) sides of the radiant infrared matrices versus burner power density for different types of matrixes: T1 and T2 uncoated matrix with thermal conductive elements, T3 and T4—uncoated conventional matrix, T5 and T6—ceramic coated matrix with thermal conductive elements, T7 and T8—ceramic coated conventional matrix are shown.

As shown in FIG. 13, thermal conductive elements provide significant surface temperature increase (by up to 200K) on downstream side of the matrix in comparison with conventional uncoated matrix at the same power density. The matrix surface temperature on the other (upstream) side of the matrix is also increased by up 200K. Similar effect of the matrix temperature increase (by 150-200K) is observed when the matrix downstream surface is ceramic coated.

Figure 14:
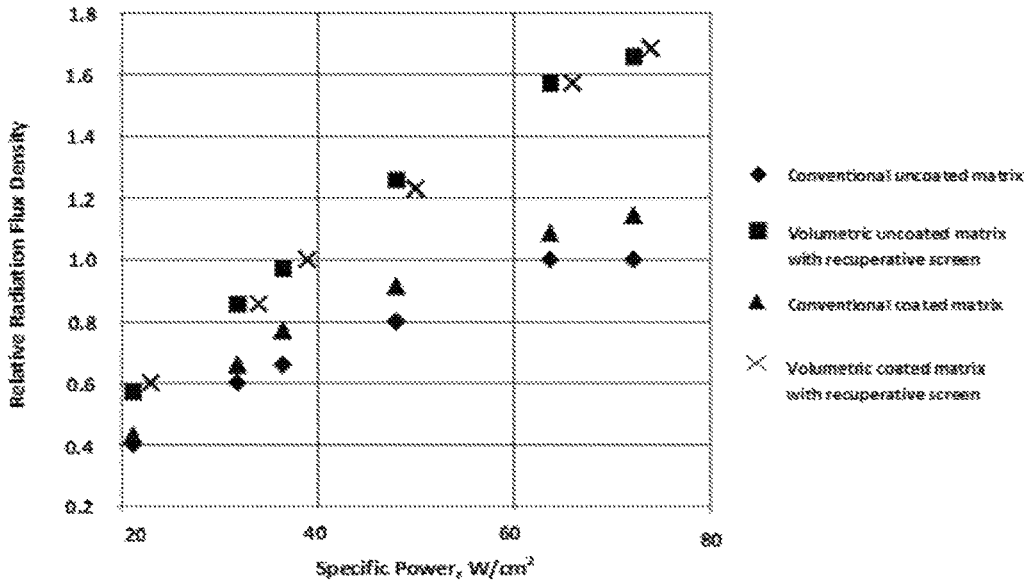
FIG. 14 is a graphical representation of relative radiation flux density versus combustion power density (specific power) in accordance with one embodiment of the subject development.

FIG. 14 is a graphical presentation of relative radiation flux density versus combustion power density (specific power) in accordance with one embodiment of the subject development. FIG. 14 shows effects of combustion power density, ceramic coating and thermal conductive elements on radiation heat flux from the matrix burner. Relative radiation flux density in FIG. 14 represents ratio of the measured radiation flux to the maximum value of measured radiation flux for conventional uncoated matrix. It was found that thermal conductive elements significantly affect the radiant heat transfer increasing the radiation flux density from the matrix by up to 1.7 times at tested conditions. The higher the combustion power density, the higher effect of the thermal conductive elements on the radiant flux. Ceramic coating increases the radiation flux density from conventional uncoated matrix by up to 20%, while the matrix downstream surface temperature remains approximately the same.

Measured temperature values of the downstream surface of coated matrix with thermal conductive elements exceed the temperature values for uncoated conventional matrix by more than 150K. With such a large difference in the temperatures, a noticeable difference in the values of the radiation flux density can be expected.

Figure 15A:
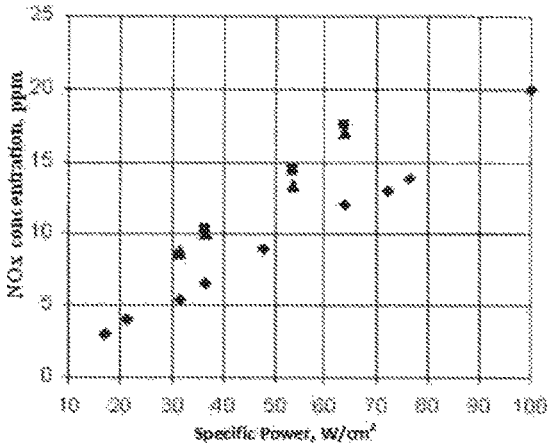
FIGS. 15A and 15B are graphical representations of the concentrations of nitrogen oxides and carbon monoxide (as measured), respectively, versus combustion power density realized in experimental testing discussed below using thermal conducting elements (plates) thickness—0.7 mm. Here 1, 2 and 3 correspond to the burner matrix with thermal conductive elements, conventional uncoated matrix and conventional coated matrix.
Figure 15B:
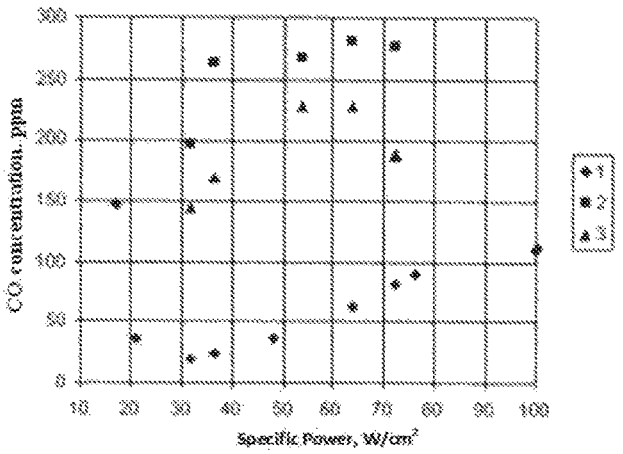

The thermal conductive elements essentially affect the composition of the combustion products or pollutant emissions. The measured concentrations of nitrogen oxides (NOx) and carbon monoxide (CO) are shown in FIGS. 15A and 15B, respectively. The concentration of NOx in combustion products is reduced by up to 1.5 times due to ceramic coating of the matrix downstream surface. Similar effect of NOx suppression was observed when thermal conductive elements were used. These can be explained due to reduction of the temperature in combustion zone.

An even more significant effect of thermal conductive elements on CO emissions was observed in the experiments. The CO concentration in combustion products of a permeable matrix with thermal conductive elements dropped up to three times in comparison with conventional uncoated matrix and up to two times in comparison with coated matrix, thus showing that thermal conductive elements are more effective for NOx and CO reduction compared to ceramic coating case. This can be explained by CO oxidation to $CO_2$ between in the region between thermal conductive elements.

The use of the thermal conductive elements in the infrared burner shows high potential for increased radiation and burner efficiency as well as reduction of both NOx and CO emissions. Design optimization of the thermal conductive elements can be done in order to further improve the burner efficiency and reduce NOx and CO emissions.

In accordance with selected preferred embodiments, the placement of the thermal elements relative to the permeable matrix is selected from one or more of the following: at least in part penetrating the matrix, flush with an upstream surface of the matrix, and protruding beyond a downstream surface of the matrix.

In accordance with selected preferred embodiments, the thermal conductivity permeable matrix base material is of a thickness of from 5 millimeters to 30 millimeters and the thermal elements are of a thickness of from 0.1 millimeters to 5 millimeters.

In accordance with selected preferred embodiments, the thermal elements are in a form selected from a group consisting of plates, rods, bars, rings, this and combinations thereof and the distance between adjacent thermal elements is between 2 millimeters and 60 millimeters.

In accordance with selected preferred embodiments, at least a portion of a downstream surface of the permeable matrix is coated with a coating material having a thermal conductivity less than the permeable matrix base material thermal conductivity and is optically transparent to IR radiation.

In accordance with selected preferred embodiments, the permeable matrix is rectangular in plan view.

In accordance with selected preferred embodiments, the permeable matrix is circular in plan view.

In accordance with selected preferred embodiments, the permeable matrix is cylindrical and the plurality of thermal conductive elements radially extend therefrom.

Those skilled in the art and guided by the teachings herein provided will understand and appreciate that the invention, including methods and devices, has broad applicability to various combustible gas mixtures. For example, in particular embodiments the invention can be applied or used in conjunction with combustible gas mixtures formed of various fuel materials, including natural gas, methane, biogas, syngas, hydrogen, turbine exhaust gas and combinations of two or more of such materials, for example, and various oxidant materials, including oxygen, air, oxygen-enriched air and combinations thereof, for example.

The invention, including methods and devices, can be suitably applied to a wide range of residential, commercial and industrial applications including, for example and without unnecessary limitation, water fair heaters/furnaces, gas turbines, syngas generators, dryers, furnaces, boilers and such other applications as may be appreciated by those skilled in the art and guided by the teachings herein provided.

The subject development illustratively disclosed herein suitably may be practiced in the absence of any element, part, step, component, or ingredient which is not specifically disclosed herein.

While in the foregoing detailed description the subject development has been described in relation to certain preferred embodiments thereof, and many details have been set forth for purposes of illustration, it will be apparent to those skilled in the art that the subject development is susceptible to additional embodiments and that certain of the details described herein can be varied considerably without departing from the basic principles of the invention. Thus, it is to be understood that various modifications and improvements can be made without departing from the spirit and scope of the invention. Further, the scope of the invention is defined by the appended claims and all changes that fall within the meaning and range of equivalents are intended to be embraced therein.

What is claimed is:

1. A method of burning a combustible gas mixture, the method comprising:

feeding the combustible gas mixture to a burner comprising a permeable matrix base material and a plurality of thermal elements disposed in thermal transfer communication with the permeable matrix base material, wherein the permeable matrix base material is a metal foam material, porous metal material, or a pressed metal wire material that forms a combustion surface and at least a portion of the thermal elements are in contact with the permeable matrix base material and exposed above the combustion surface, the permeable matrix base material having a first thermal conductivity and the thermal elements having a thermal conductivity higher than the permeable matrix material thermal conductivity;

preheating the combustible gas mixture as it passes through the permeable matrix material; and combusting the preheated combustible gas mixture at or near exit pores and channels formed at the combustion surface of the permeable matrix material and between thermal elements exposed above the combustion surface;

wherein the preheating includes a combustion heat transfer to the permeable matrix base material through the thermal transfer communication with the thermal elements.

2. The method of claim 1 wherein at least one of the thermal elements is at least partially disposed in the permeable matrix base material.

3. The method of claim 1 wherein the permeable matrix base material comprises a metal material selected from the group consisting of chromal, kanthal, heat-resistant steel, carbide of titanium, aluminum, iron, chromium, yttrium and combinations thereof.

4. The method of claim 1 wherein the thermal elements comprise a high temperature metal or metal alloy material selected from the group consisting of stainless steel, heat-resistant steel, graphite, chromium, iron, iridium, lithium, nickel, nickel-based alloy and combinations thereof.

5. The method of claim 1 wherein the thermal elements are of a form selected from a group consisting of plates, rods, bars, rings, fins and combinations thereof.

6. The method of claim 1 wherein the thermal elements are spaced apart from adjacent thermal elements by a distance of 2 millimeters to 60 millimeters.

7. The method of claim 1 wherein the permeable matrix base material has an upstream matrix surface and a downstream matrix surface and wherein the thermal elements include a base end flush with the upstream matrix surface and extend for a length of 1 to 15 millimeters beyond the downstream matrix surface.

8. The method of claim 1 wherein the combustion surface is at least in part coated with a coating material, the coating material having a thermal conductivity less than the permeable matrix material thermal conductivity and is optically transparent to IR radiation, and wherein the surface of the permeable matrix base material at least in part coated with the coating material emits an increased amount of radiation energy and a decreased concentration of pollutant components in the combustion products as compared to the permeable matrix base material without the coating material;

wherein the burner comprises a ratio of thermal conductivity of the permeable matrix base material and to the coating material is from 3 to 10; and wherein the coating material comprises a ceramic and wherein the coating is of a thickness of 10 to 500 microns and the permeable matrix base material comprises a metal material.

9. The method of claim 8 wherein the at least a portion of the thermal elements exposed above the combustion surface is coated with the coating material.

10. A radiant infrared premixed gas burner, the burner comprising:

a permeable matrix base material providing surface stabilized combustion of a combustible gas mixture upon exit of the combustible mixture through pores and channels of the base material, the permeable matrix base material being a metal foam material, porous metal material, or a pressed metal wire material, and having a first thermal conductivity and configured to preheat the combustible gas mixture as it travels through the permeable matrix material; and a plurality of thermal elements disposed in thermal transfer contact with the permeable matrix base material, wherein the permeable matrix base material forms a combustion surface and at least a portion of the thermal elements are exposed above the combustion surface, the thermal elements having a thermal conductivity higher than the permeable matrix material thermal conductivity, and the thermal elements configured to transfer thermal energy of the surface stabilized combustion to the permeable matrix base material for the preheat.

11. The radiant infrared premixed gas burner of claim 10 additionally comprising:

a fuel inlet for receiving a gaseous fuel;

an oxidizer inlet for receiving an oxidizer gas; and a mixer for mixing gaseous fuel and oxidizer gas to produce a combustible gas mixture.

12. The radiant infrared premixed gas burner of claim 10 wherein at least one of the thermal elements is at least partially disposed in the permeable matrix base material.

13. The radiant infrared premixed gas burner of claim 12 wherein placement of the thermal elements relative to the permeable matrix is selected from one or more of the following: at least in part penetrating the matrix, flush with an upstream surface of the matrix, and protruding beyond a downstream surface of the matrix.

14. The radiant infrared premixed gas burner of claim 10 wherein the permeable matrix base material is of a thickness of from 5 millimeters to 30 millimeters and the thermal elements are of a thickness of from 0.1 millimeters to 5 millimeters.

15. The radiant infrared premixed gas burner of claim 10 wherein the thermal elements are in a form selected from a group consisting of plates, rods, bars, rings, fins and combinations thereof and the distance between adjacent thermal elements is between 2 millimeters and 60 millimeters.

16. The radiant infrared premixed gas burner of claim 10 wherein the thermal elements protrude beyond the combustion surface of the matrix in a height equal to 0.5-5 times the distance between elements.

17. The radiant infrared premixed gas burner of claim 10 wherein the permeable matrix is cylindrical with a central axis and each thermal element of the plurality of thermal elements is planar shaped and extends radially from within the permeable matrix.

18. The radiant infrared premixed gas burner of claim 10 additionally comprising a coating of a material optically transparent to IR radiation on at least a portion of a downstream surface of the permeable matrix surface and thermal elements.

19. A radiant infrared premixed gas burner, the burner comprising:

a permeable matrix base material providing surface stabilized combustion of a combustible gas mixture upon exit of the combustible mixture through pores and channels of the base material, the permeable matrix base material having a first thermal conductivity and configured to preheat the combustible gas mixture as it travels through the permeable matrix material, and a plurality of thermal elements disposed in thermal transfer communication with the permeable matrix base material, wherein the permeable matrix base material forms a combustion surface and at least a portion of the thermal elements are exposed above the combustion surface, the thermal elements having a thermal conductivity higher than the permeable matrix material thermal conductivity, and the thermal elements configured to transfer thermal energy of the surface stabilized combustion to the permeable matrix base material for the preheat, wherein at least a portion of a downstream surface of the permeable matrix and the at least a portion of the thermal elements exposed above the combustion surface is coated with a coating material having a thermal conductivity less than the permeable matrix base material thermal conductivity and is optically transparent to IR radiation, wherein the coating material comprises a ceramic and wherein the coating is of a thickness of 10 to 500 microns and the permeable matrix base material comprises a metal material.

* * * * *